US009992604B2

(12) United States Patent
Cai

(10) Patent No.: US 9,992,604 B2
(45) Date of Patent: Jun. 5, 2018

(54) ERROR MODEL-BASED MULTI-ZONE SOUND REPRODUCTION METHOD AND DEVICE

(71) Applicant: SUZHOU SONAVOX ELECTRONICS CO., LTD., Suzhou, Jiangsu (CN)

(72) Inventor: Yefeng Cai, Jiangsu (CN)

(73) Assignee: SUZHOU SONAVOX ELECTRONICS CO., LTD., Suzhou, Jiangsu (CN)

( * ) Notice: Subject to any disclaimer, the term of this patent is extended or adjusted under 35 U.S.C. 154(b) by 69 days.

(21) Appl. No.: 15/325,366

(22) PCT Filed: Dec. 29, 2014

(86) PCT No.: PCT/CN2014/095345
§ 371 (c)(1),
(2) Date: Jan. 10, 2017

(87) PCT Pub. No.: WO2016/065719
PCT Pub. Date: May 6, 2016

(65) Prior Publication Data

US 2017/0201848 A1 Jul. 13, 2017

(30) Foreign Application Priority Data

Oct. 30, 2014 (CN) ..... 2014 1 0597657

(51) Int. Cl.
*H04R 5/02* (2006.01)
*H04S 7/00* (2006.01)
*H04R 29/00* (2006.01)

(52) U.S. Cl.
CPC ..... *H04S 7/307* (2013.01); *H04R 5/02* (2013.01); *H04R 29/002* (2013.01)

(58) Field of Classification Search
CPC ..... H04S 7/303; H04S 7/301; H04S 7/307; H04S 7/30; H04S 2400/11; H04S 7/302; H04R 3/04
(Continued)

(56) References Cited

U.S. PATENT DOCUMENTS

2014/0133665 A1* 5/2014 Xiang ..... H04R 3/005 381/59

FOREIGN PATENT DOCUMENTS

CN 103916730 7/2014
CN 103916733 7/2014
(Continued)

OTHER PUBLICATIONS

International search report dated Jul. 29, 2015 from corresponding application No. PCT/CN2014/095345.

*Primary Examiner* — George Monikang
(74) *Attorney, Agent, or Firm* — Hauptman Ham LLP

(57) ABSTRACT

An error model-based multi-zone sound reproduction method includes arranging a speaker array, and setting control points for a bright zone and a dark zone. The bright zone is a zone requiring the generation of an independent sound source. The dark zone is a zone not requiring the generation of an independent sound source. The method further includes conducting probability distribution modeling on the speaker frequency response errors. The method further includes, according to the error distribution model, respectively listing expected average sound energy expressions of the bright zone and the dark zone and a frequency response consistency constraint expression of the bright zone. The method further includes calculating a time-domain impulse response filter signal of each channel according to the time-domain sound energy contrast control criterion of the frequency response consistency constraint.

9 Claims, 3 Drawing Sheets

(58) Field of Classification Search
USPC ..... 381/302, 303, 310, 71.1, 71.4, 71.8, 381/71.11
See application file for complete search history.

(56) References Cited

FOREIGN PATENT DOCUMENTS

| | | |
|---|---|---|
| CN | 103916810 | 7/2014 |
| WO | WO2014160419 | 10/2014 |

* cited by examiner

ERROR MODEL-BASED MULTI-ZONE SOUND REPRODUCTION METHOD AND DEVICE

RELATED APPLICATIONS

The present application is a National Phase of International Application Number PCT/CN2014/095345, filed Dec. 29, 2014, and claims the priority of China Application No. 201410597657.0, filed Oct. 30, 2014, which are incorporated herein by reference in their entireties.

FIELD OF INVENTION

The present invention relates to the acoustics field, in particular, to an error model-based multi-zone sound reproduction method and device.

BACKGROUND OF THE INVENTION

In recent years, with the rapid development of science and technology and the improvement of living standards, cars also occupy an increasingly important position in people's lives, and the users pay more and more attention to the acoustic environment in the car. Today, the car is often filled with a variety of sounds, such as music, navigation voices, telephone sounds, warning sounds and the like. Usually different people in the car want to listen to different voices, such as the driver wants to listen to navigation voices and warning sounds, the passengers seating in the back seats may want to listen to music. In some home theater applications there are also problems that the users of different areas want to listen to different sounds, or due to that the hearing thresholds are different, different users want to hear sounds of different volumes. In museums and other exhibition areas, the sounds of exhibits should not interfere with each other, that is, only sounds related to different exhibits can appear in front of related exhibits, thereby enhancing the user experience feelings. Similarly, the restaurant also needs to play different background music in different areas to meet different hobbies of customers. In the above scenarios, the existing sound system cannot generate independent sound sources in different areas, and cannot meet the needs of users. Although wearing earphones can solve the problem of mutual interference of sounds in respective regions, wearing earphones for a long time will not only cause the user to feel fatigue, but also damage hearing of the user.

A multi-zone sound reproduction system adjusts amplitudes and phases of input signals via a speaker array, and produces respective independent sound sources in multiple regions, creates personalized listening space for users, and avoids feeling of fatigue brought by wearing earphones. One control method commonly used in multi-zone sound reproduction systems is the sound energy contrast control method. The sound energy contrast control methods are divided into two major categories: frequency domain design and time domain design. The frequency domain sound energy contrast control method in the prior art cannot guarantee the causality of the time-domain impulse response filter signals, and hence the contrast performance at the non-control frequency point may decrease. The time domain sound energy contrast control method in the prior art directly avoid non-causal problems of the time-domain impulse response filter signals in the time-domain design, and hence the decreasing of the contrast performance at the non-control frequency point in frequency domain sound energy contrast control method can be solved. However, the time-domain sound energy contrast control method in the prior art does not take the errors in speaker frequency responses into account, which is far from the actual.

The problems of the time-domain sound energy contrast control method in the prior art will reduce the contrast performance of the multi-zone sound reproduction system, enlarge the mutual interference between the sound fields of respective regions, cannot create a personalized private listening space for each user, and will reduce the possibility of mass production of real systems. Aiming at the problem of contrast performance decrease introduced by speaker frequency response errors in the existing sound energy contrast control method, it is necessary to find a more simple and effective method to overcome the contrast performance decrease introduced by the speaker frequency response errors.

SUMMARY

The present invention is intended to overcome the problem of contrast performance decrease introduced by speaker frequency response errors in the sound energy contrast control method in the prior art, and thereby provide a time-domain sound energy contrast control method capable of improving the contrast performance with the speaker frequency response errors existing.

To achieve the above purposes, the present invention provides an error model-based multi-zone sound reproduction method comprising:

Step 1): arranging a speaker array, and setting control points for a bright zone and a dark zone; wherein, the bright zone is a zone requiring the generation of an independent sound source, and the dark zone is all zones not requiring the generation of an independent sound source;

Step 2): establishing a distribution model of speaker frequency response errors;

Step 3): according to the distribution model of speaker frequency response errors of Step 2) and the speak array, deriving expected average sound energy expressions and frequency response consistency constraint expressions of the bright zone and the dark zone with speaker frequency response errors existing;

Step 4): according to the expected average sound energy expressions and the frequency response consistency constraint expressions of Step 3), and according to a time-domain sound energy contrast control criterion of the frequency response consistency constraint, calculating a time-domain impulse response filter signal of each channel.

Preferably, in the Step 1), the arranged speaker array is a linear array, a circular array, or a random array.

Preferably, in the Step 1), the shape of the bright zone is square, circular, or linear;

or the shape of the dark zone is square, circular, or linear.

Preferably, in the Step 2), the error probability distribution model is obtained by measurement or by model prediction.

Preferably, a measuring method of the distribution model of speaker frequency response errors of Step 2) comprises:

(1) measuring frequency responses of a set of speakers at frequency f, and obtaining amplitude distribution and phase distribution of the speaker frequency responses, respectively;

(2) acquiring the distribution model of speaker frequency response errors by fitting distribution curves according to the amplitude distribution and the phase distribution of the speaker frequency responses.

Preferably, a predicting method of the distribution model of speaker frequency response errors of Step 2) comprises:

(1) measuring the speaker array of the Step 1) by acoustic instruments to obtain TS parameters, the TS parameters comprising voice coil direct current resistance, voice coil inductance, mechanical resistance, mechanical compliance, vibration quality, air radiation resistance, air radiation susceptibility, equivalent radiating area, and electromagnetic force induction coefficient;

(2) sampling the TS parameters by Monte Carlo method, simulating frequency responses of the speaker, and obtaining amplitude distribution and phase distribution of the speaker frequency responses;

(3) conducting curve-fitting according to the obtained amplitude distribution and phase distribution of the speaker frequency responses, and acquiring the distribution model of speaker frequency response errors.

Preferably, the Step 3) comprises:

Step 3-1): assuming the frequency response error of speaker l at frequency ω is:

$$A_l(\omega)=a_l(\omega)e^{-j\varphi_l(\omega)}$$

wherein, $a_l(\omega)$ and $\varphi_l(\omega)$ respectively are amplitude and phase of the frequency response error and both are random variates. Then, the frequency response from the speaker array to a control point k=1 . . . $K_B$ of the bright zone is:

$$\bar{p}_{Bk}(\omega)=w^T[s_{Bk}(\omega)\circ A]$$

wherein, $K_B$ is the number of control points in the bright zone; ○ is the Hadamard product of matrix, and w is a vector formed by time-domain impulse response filter coefficients of each channel an expression of which is:

$$w=[w_l(0), \ldots, w_l(M-1), \ldots, w_L(0), \ldots, w_L(M-1)]^T$$

wherein, M is the filter order of each channel; an expression of $s_{Bk}(\omega)$ is:

$$s_{Bk}(\omega)=[r_{Bk}(0), \ldots, r_{Bk}(M+1-2)][1, e^{-j\omega}, \ldots, e^{-j\omega(I+M-2)}]^T$$

$$r_{Bk}(n)=[h_{Blk}(n), \ldots, h_{Blk}(n-M+1), \ldots, h_{BLk}(n), \ldots, h_{BLk}(n-M+1)]^T$$

wherein impulse responses between channel l of the speaker and control point k of the bright zone are modeled to be a FIR filter with a length of I, $h_{Blk}(n)$ is coefficient. An expression of A is:

$$A = [\underbrace{A_1(\omega), \ldots, A_1(\omega)}_{M\times 1}, \ldots, \underbrace{A_L(\omega), \ldots, A_L(\omega)}_{M\times 1}]^T.$$

The time-domain average sound energy $\bar{e}_B$ radiated from the speaker array to the bright zone is:

$$\bar{e}_B = \sum_{k=1}^{K_B} \frac{1}{2\pi} \int_{-\pi}^{\pi} |\bar{p}_{Bk}(\omega)|^2 d\omega / K_B.$$

Since $\bar{e}_B$ is a random variate, the expected average sound energy $E\{\bar{e}_B\}$ of the bright zone is:

$$E\{\bar{e}_B\} = w^T E\left\{\sum_{k=1}^{K} \frac{1}{2\pi} \int_{-\pi}^{\pi} [s_{Bk}(\omega)\circ A][s_{Bk}(\omega)\circ A]^H d\omega / K_B\right\} w$$

-continued $$= w^T \sum_{k=1}^{K} \frac{1}{2\pi} \int_{-\pi}^{\pi} s_{Bk}(\omega) s_{Bk}(\omega)^H \circ E\{AA^H\} d\omega / K_B w$$

$$= w^T R_B w$$

wherein, E{ } is an expected value of random variate, and $E\{AA^H\}$ comprises parameters of the error probability distribution model provided by Step 2).

Step 3-2): frequency response $\bar{p}_{Dk}(\omega)$ from the speaker array to a control point k=1 . . . $K_D$ of the dark zone is:

$$\bar{p}_{Dk}(\omega)=w^T[s_{Dk}(\omega)\circ A],$$

wherein, an expression of $s_{Dk}(\omega)$ is:

$$s_{Dk}(\omega)=[r_{Dk}(0), \ldots, r_{Dk}(M+I-2)][1, e^{-j\omega}, \ldots, e^{-j\omega(I+M-2)}]^T$$

$$r_{Dk}(n)=[h_{Dlk}(n), \ldots, h_{Dlk}(n-M+1), \ldots, h_{DLk}(n), \ldots, h_{DLk}(n-M+1)]^T$$

wherein impulse responses between channel l of the speaker and control point k of the dark zone are modeled to be a FIR filter with a length of 1 $h_{Dlk}(n)$ is coefficient; hence the expected average sound energy of the dark zone is:

$$E\{\bar{e}_D\} = \sum_{k=1}^{K_D} \frac{1}{2\pi} \int_{-\pi}^{\pi} |\bar{p}_{Dk}(\omega)|^2 d\omega / K_D$$

$$= w^T \sum_{k=1}^{K_D} \frac{1}{2\pi} \int_{-\pi}^{\pi} s_{Dk}(\omega) s_{Dk}(\omega)^H \circ E\{AA^H\} d\omega / K_D w$$

$$= w^T R_D w$$

Step 3-3): selecting a reference frequency $\omega_r$, and defining frequency response consistency constraint RV of the bright zone an expression of which is:

$$RV = \frac{1}{K_B} \frac{1}{B_\Omega} \sum_{k=1}^{K} \sum_{\omega\in\Omega} |w^T s_{Bk}(\omega) - w^T s_{Bk}(\omega_r)|^2$$

$$= w^T \Re\{Q^H Q\} w$$

wherein, ℜ { } is taking the real part of this element, Ω is a set of all constraint frequency points, and an expression of Q is:

$$Q = \frac{1}{\sqrt{K_B B_\Omega}} \begin{pmatrix} s_{B1}(\omega) - s_{B1}(\omega_r) \\ \vdots \\ s_{BK}(\omega) - s_{BK}(\omega_r) \end{pmatrix}.$$

Preferably, the Step 4) comprises:

Step 4-1): according to the time-domain sound energy contrast control criterion of the frequency response consistency constraint, listing an optimization function:

$$\max_w \frac{w^T R_B w}{\alpha w^T R_D w + (1+\alpha) w^T \Re\{Q^H Q\} w + \delta w^T w}$$

Step 4-2): solving the optimization function in Step 4-1):

$$w=P_{max}\{[\alpha R_D+(1-\alpha)\Re\{Q^HQ\}+\delta U]^{-1}R_B\}$$

wherein, $P_{max}\{\ \}$ is to solve an unit feature vector of corresponding maximum feature value of the matrix, U is unit matrix, δ is robustness parameter, and α is weighting parameter; parameters δ and α both take positive numbers;

Step 4-3): dividing the vector w obtained in Step 4-2) by every M elements, and obtaining the time-domain impulse response filter signal of each channel.

The present invention further provides an error model-based multi-zone sound reproduction device comprising, a speaker array arranging module, to arrange the speaker array, and to set control points for a bright zone and a dark zone, wherein, the bright zone is a zone requiring the generation of an independent sound source, and the dark zone is all zones not requiring the generation of an independent sound source;

a speaker frequency response error obtaining module, to conduct probability distribution modeling on frequency response errors;

an expected average sound energy expression obtaining module, to list expected average sound energy expressions of the bright zone and the dark zone respectively;

a frequency response consistency constraint expression obtaining module, to select a reference frequency, and to list a frequency response consistency constraint expression of the bright zone;

a time-domain impulse response filter signal calculating module, to calculate a time-domain impulse response filter signal of each channel according to a time-domain sound energy contrast control criterion of the frequency response consistency constraint.

The advantages of the present invention are:

1. The present invention directly avoids non-causality of the time-domain impulse response filter signals derived from inverse Fourier transform in the time-domain design in the frequency domain sound energy contrast control design method, and the wide band contrast performance thereof may be larger than the wide band contrast performance of the frequency domain sound energy contrast control method.

2. The present invention conducts probability distribution modeling on the speaker frequency response errors, and utilizes this error model in the control design, and may effectively reduce effects of contrast ratio performance degradation introduced by speaker frequency response errors when compared to the time domain sound energy contrast control design method, and may improve robustness and reliability of the device.

3. The multi-zone sound reproduction device of the present invention may be applied in fields like home theater, car audio and other requiring the generation of multiple independent sound sources, may effectively reduce the speaker frequency errors and create a good private listening space.

BRIEF DESCRIPTION OF THE DRAWINGS

FIG. 3(*b*) is a corresponding Gaussian distribution fitting curve of an experimental distribution of speaker frequency phase errors;

FIG. 4(*b*) is a comparing schematic diagram of the contrast performances of the present invention and the existing methods when the speaker frequency response errors are in Gaussian distribution.

DETAILED DESCRIPTION OF EXEMPLARY EMBODIMENTS

In the following, the specific embodiments are combined to further explain the present invention in detail. It should be understood that, those embodiments are to explain the basic principle, major features and advantages of the present invention, and the present invention is not limited by the scope of the following embodiments. The implementation conditions employed by the embodiments may be further adjusted according to particular requirements, and undefined implementation conditions usually are conditions in conventional experiments.

The basic concept of the present invention is conducting probability distribution modeling on the speaker frequency response errors, getting expected average sound energy of the bright and dark zones, and designing by employing a time-domain sound energy contrast control criterion based on a frequency response consistency constraint such that a multi-zone sound reproduction device may effectively reduce the contrast performance degradation introduced by speaker frequency response errors and improve the robustness of the system. The method of the present invention designed based on the above concepts eliminates problems introduced by that the sound energy contrast control method in the prior art does not take the errors in speaker frequency responses into account.

Figure 1:
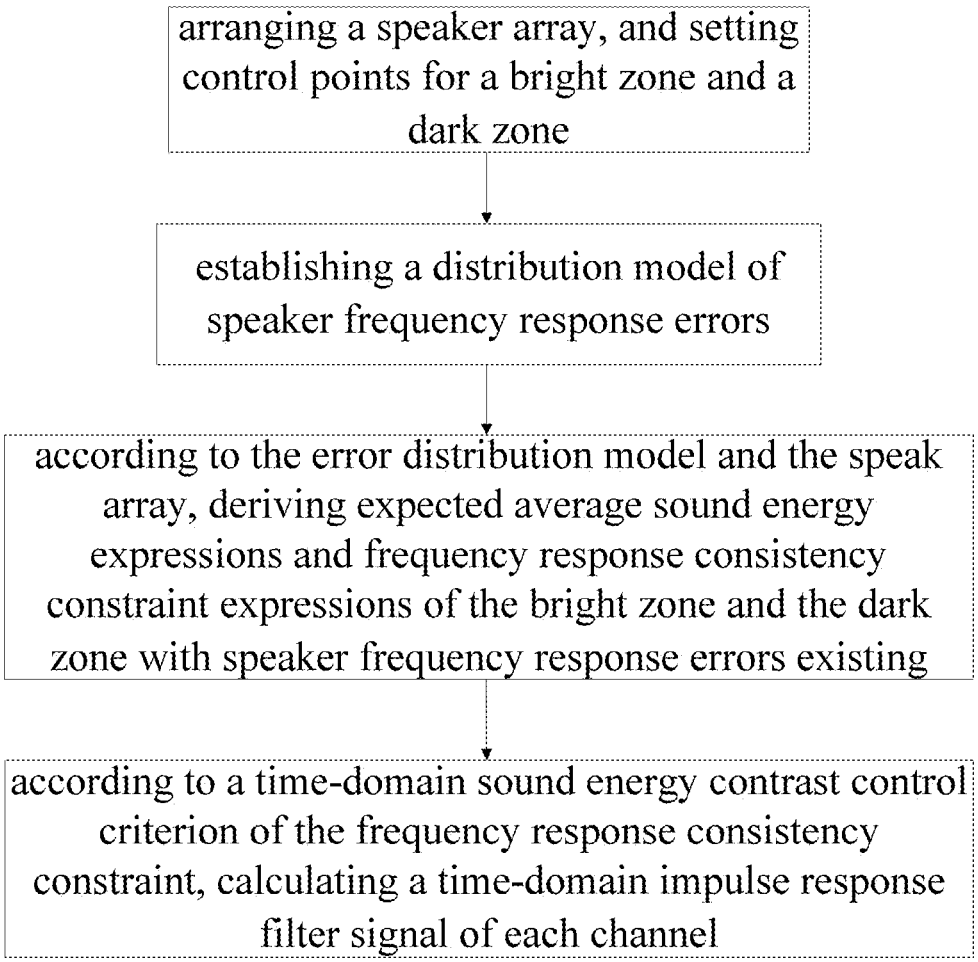
FIG. 1 is a flow chart of an error model-based multi-zone sound reproduction method of the present invention.

Referring to FIG. 1, an error model-based multi-zone sound reproduction method of the present invention, comprises the following steps:

Step 1): arranging a speaker array, and setting control points for a bright zone and a dark zone; wherein, the bright zone is a zone requiring the generation of an independent sound source, and the dark zone is all zones not requiring the generation of an independent sound source;

Step 2): establishing a distribution model of speaker frequency response errors;

Step 3): according to the error distribution model of Step 2) and the speak array, deriving expected average sound energy expressions and frequency response consistency constraint expressions of the bright zone and the dark zone with speaker frequency response errors existing;

Step 4): calculating a time-domain impulse response filter signal of each channel according to a time-domain sound energy contrast control criterion of the frequency response consistency constraint.

In the following, the respective steps in the method of the present invention are further described.

In Step 1), the arranged speaker array is a linear array or a circular array, or also may be a random array. The shape of the bright zone or the dark zone is a square or a circle, or also may be a line.

In the Step 2), the error probability distribution model is obtained by measurement or by model prediction.

A measuring method of the distribution model of speaker frequency response errors in Step 2) comprises:

(1) measuring frequency responses of a set of speakers at frequency f, and obtaining amplitude distribution and phase distribution of the speaker frequency responses, respectively;

(2) acquiring the distribution model of speaker frequency response errors by fitting distribution curves according to measured actual distribution.

A predicting method of the distribution model of speaker frequency response errors in Step 2) comprises:

(1) measuring the speaker array of the Step 1) by acoustic instruments to obtain TS parameters, the TS parameters comprising voice coil direct current resistance, voice coil inductance, mechanical resistance, mechanical compliance, vibration quality, air radiation resistance, air radiation susceptibility, equivalent radiating area, and electromagnetic force induction coefficient;

(2) sampling the TS parameters by Monte Carlo method, simulating frequency responses of the speaker, and obtaining amplitude distribution and phase distribution of the speaker frequency responses;

(3) conducting curve-fitting according to the obtained amplitude distribution and phase distribution of the speaker frequency responses, and acquiring the distribution model of speaker frequency response errors.

Step 3) specifically comprises the following:

Step 3-1): assuming the frequency response error of speaker l at frequency ω is:

$$A_l(\omega)=a_l(\omega)e^{-j\varphi_l(\omega)}$$

wherein, $a_l(\omega)$ and $\varphi_l(\omega)$ respectively are amplitude and phase of the frequency response error and both are random variates. Then, the frequency response from the speaker array to a control point k=1 . . . $K_B$ of the bright zone is:

$$\bar{p}_{Bk}(\omega)=w^T[s_{Bk}(\omega)\circ A]$$

wherein, ○ is the Hadamard product of matrix, and w is a vector formed by time-domain impulse response filter coefficients of each channel an expression of which is:

$$w=[w_l(0), \ldots, w_l(M-1), \ldots, w_L(0), \ldots, w_L(M-1)]^T$$

wherein, M is the filter order of each channel; an expression of $s_{Bk}(\omega)$ is:

$$s_{Bk}(\omega)=[r_{Bk}(0), \ldots, r_{Bk}(M+I-2)][1, e^{-j\omega}, \ldots, e^{-j\omega(I+M-2)}]^T$$

$$r_{Bk}(n)=[h_{Blk}(n), \ldots, h_{Blk}(n-M+1), \ldots, h_{BLk}(n), \ldots, h_{BLk}(n-M+1)]^T$$

wherein impulse responses between channel l of the speaker and control point k of the bright zone are modeled to be a FIR filter with a length of I, $h_{Blk}(n)$ is coefficient. An expression of A is:

$$A=[\underbrace{A_1(\omega), \ldots, A_1(\omega)}_{M\times 1}, \ldots, \underbrace{A_L(\omega), \ldots, A_L(\omega)}_{M\times 1}]^T.$$

The time-domain average sound energy $\bar{e}_B$ radiated from the speaker array to the bright zone is:

$$\bar{e}_B=\sum_{k=1}^{K_B}\frac{1}{2\pi}\int_{-\pi}^{\pi}|\bar{p}_{Bk}(\omega)|^2 d\omega/K_B.$$

Since $\bar{e}_B$ is a random variate, the expected average sound energy $E\{\bar{e}_B\}$ of the bright zone is:

$$\begin{aligned}E\{\bar{e}_B\}&=w^T E\left\{\sum_{k=1}^{K}\frac{1}{2\pi}\int_{-\pi}^{\pi}[s_{Bk}(\omega)\circ A][s_{Bk}(\omega)\circ A]^H d\omega/K_B\right\}w\\&=w^T\sum_{k=1}^{K}\frac{1}{2\pi}\int_{-\pi}^{\pi}s_{Bk}(\omega)s_{Bk}(\omega)^H\circ E\{AA^H\}d\omega/K_B w\\&=w^T R_B w\end{aligned}$$

wherein, E{ } is an expected value of random variate, and $E\{AA^H\}$ comprises parameters of the error probability distribution model provided by Step 2).

Step 3-2): frequency response $\bar{p}_{Dk}(\omega)$ from the speaker array to a control point k=1 . . . $K_D$ of the dark zone is:

$$\bar{p}_{Dk}(\omega)=w^T[s_{Dk}(\omega)\circ A]$$

wherein, an expression of $s_{Dk}(\omega)$ is:

$$s_{Dk}(\omega)=[r_{Dk}(0), \ldots, r_{Dk}(M+I-2)][1, e^{-j\omega}, \ldots, e^{-j\omega(I+M-2)}]^T$$

$$r_{Dk}(n)=[h_{Dlk}(n), \ldots, h_{Dlk}(n-M+1), \ldots, h_{DLk}(n), \ldots, h_{DLk}(n-M+1)]^T$$

wherein impulse responses between channel l of the speaker and control point k of the dark zone are modeled to be a FIR filter with a length of I, $h_{Dlk}(n)$ is coefficient; hence the expected average sound energy of the dark zone is:

$$\begin{aligned}E\{\bar{e}_D\}&=\sum_{k=1}^{K_D}\frac{1}{2\pi}\int_{-\pi}^{\pi}|\bar{p}_{Dk}(\omega)|^2 d\omega/K_D\\&=w^T\sum_{k=1}^{K_D}\frac{1}{2\pi}\int_{-\pi}^{\pi}s_{Dk}(\omega)s_{Dk}(\omega)^H\circ E\{AA^H\}d\omega/K_D w\\&=w^T R_D w\end{aligned}$$

Step 3-3): selecting a reference frequency $\omega_r$, and defining frequency response consistency constraint RV of the bright zone an expression of which is:

$$\begin{aligned}RV&=\frac{1}{K_B}\frac{1}{B_\Omega}\sum_{k=1}^{K}\sum_{\omega\in\Omega}|w^T s_{Bk}(\omega)-w^T s_{Bk}(\omega_r)|^2\\&=w^T\Re\{Q^H Q\}w\end{aligned}$$

wherein, ℜ { } is taking the real part of this element, Ω is a set of all constraint frequency points, and an expression of Q is:

$$Q=\frac{1}{\sqrt{K_B B_\Omega}}\begin{pmatrix}s_{B1}(\omega)-s_{B1}(\omega_r)\\ \vdots\\ s_{BK}(\omega)-s_{BK}(\omega_r)\end{pmatrix}.$$

Step 4) specifically comprises the following:

Step 4-1): according to the time-domain sound energy contrast control criterion of the frequency response consistency constraint, listing an optimized question:

$$\max_w\frac{w^T R_B w}{\alpha w^T R_D w+(1-\alpha)w^T\Re\{Q^H Q\}w+\delta w^T w}$$

Step 4-2): solving the optimized question obtained in Step 4-1):

$$w=P_{max}\{[\alpha R_D+(1-\alpha)\Re\{Q^H Q\}+\delta U]^{-1}R_B\}$$

wherein, $P_{max}\{\ \}$ is to solve an unit feature vector of corresponding maximum feature value of the matrix, U is unit matrix, δ is robustness parameter, and α is weighting parameter; parameters δ and α both take positive numbers;

Step 4-3): dividing the vector w obtained in Step 4-2) by every M elements, and obtaining the time-domain impulse response filter signal of each channel.

For understanding the present invention better, the methods of the present invention are further described in detail combining the accompany figures and specific embodiments in the following.

Figure 2:
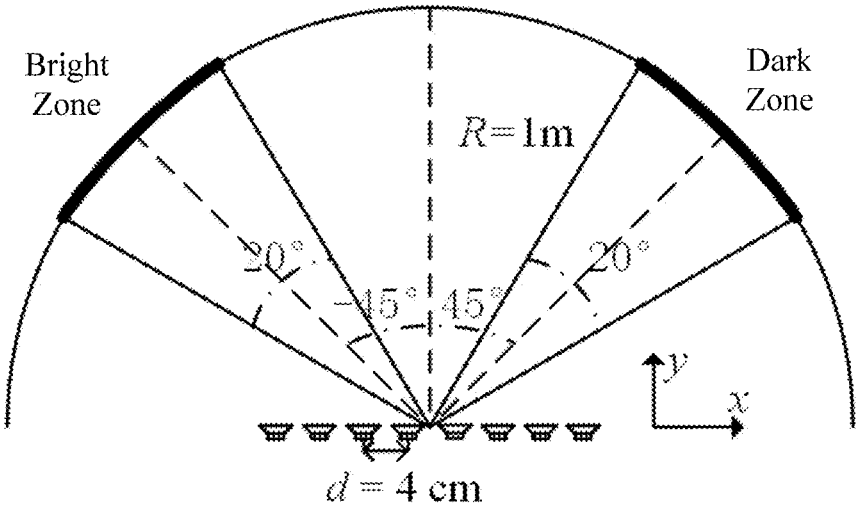
FIG. 2 is a schematic arrangement diagram of the bright and dark zones in a linear speaker array in an embodiment.

In a simulated embodiment, as shown in FIG. 2, a linear speaker array is arranged, and the bright zone and the dark zone are located in directions at 45 degree of the midperpendicular of the speaker array in the left and right sides respectively, both away from the speaker array with a distance of 1 m, and in the same horizontal plane of the speaker array; wherein the speaker array is formed by 8 units with a spacing of 4 m.

Figure 3A:
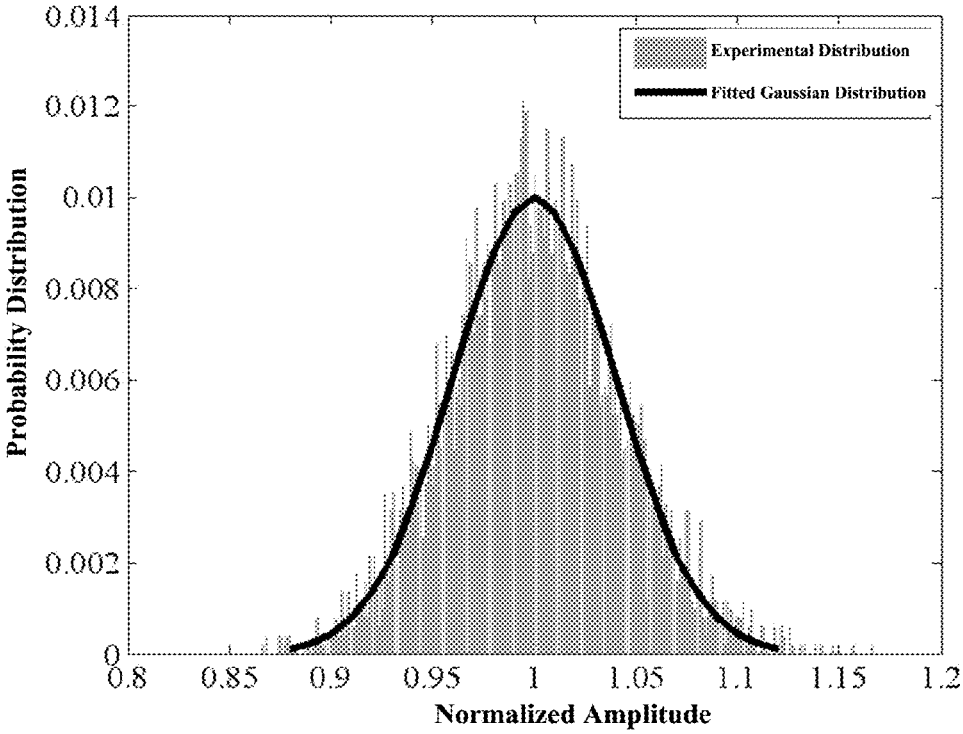
FIG. 3(*a*) is a corresponding Gaussian distribution fitting curve of an experimental distribution of speaker frequency amplitude errors.
Figure 3B:
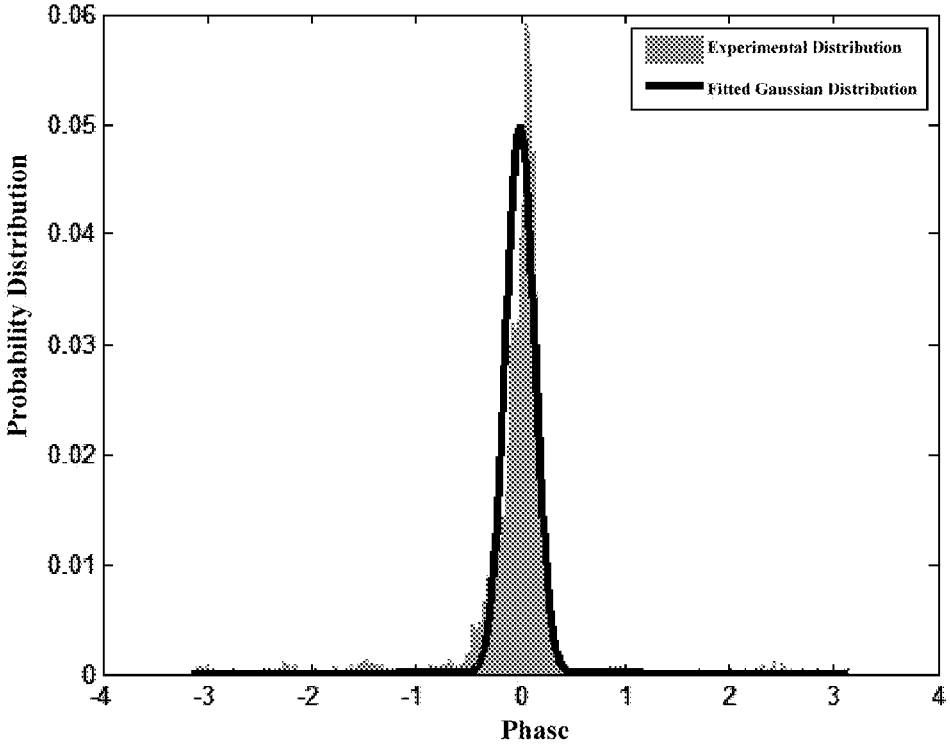

The specific implementing process of this embodiment comprises following steps:

(1) obtaining the probability distribution of speaker frequency response errors, and assuming that probability distribution of speaker frequency response errors at each frequency points are uniform. FIG. 3(*a*) presents a corresponding Gaussian distribution fitting curve of an experimental distribution of amplitude errors. FIG. 3(*b*) presents a corresponding Gaussian distribution fitting curve of an experimental distribution of phase errors. In the simulation, two kinds of error distributions are directly assumed, and the system performances are compared under those conditions. A first distribution is even distribution, with amplitude errors evenly distributed between [0.88, 1.12], and with phase errors evenly distributed between [−24°, 24° ]. A second distribution is Gaussian distribution, the mean value and standard deviation parameter of amplitude error distribution are 1 and 0.04 respectively, and the mean value and standard deviation parameter of phase error distribution are 0° and 8°.

(2) The simulated environment is a free sound field, the system sampling frequency is set as 8 kHz, the impulse responses from the speaker to the control points is modeled to a FIR filter with a length I of 1600 order, the time-domain impulse response filter length of each channel is set as 100, and the expected average sound energy of the bright zone and the dark zone are listed.

(3) The reference frequency is set as 1 kHz, the constraint frequency point is [80, 80×2, . . . 80×49] Hz, and the expression of the frequency response consistency constraint is listed.

(4) according to the time-domain sound energy contrast control of the frequency response consistency constraint, calculating weighting vector w, wherein δ is 0.5, and β is 0.000005.

(5) dividing the vector w by every M elements, and obtaining the time-domain impulse response filter signal of each channel.

Figure 4A:
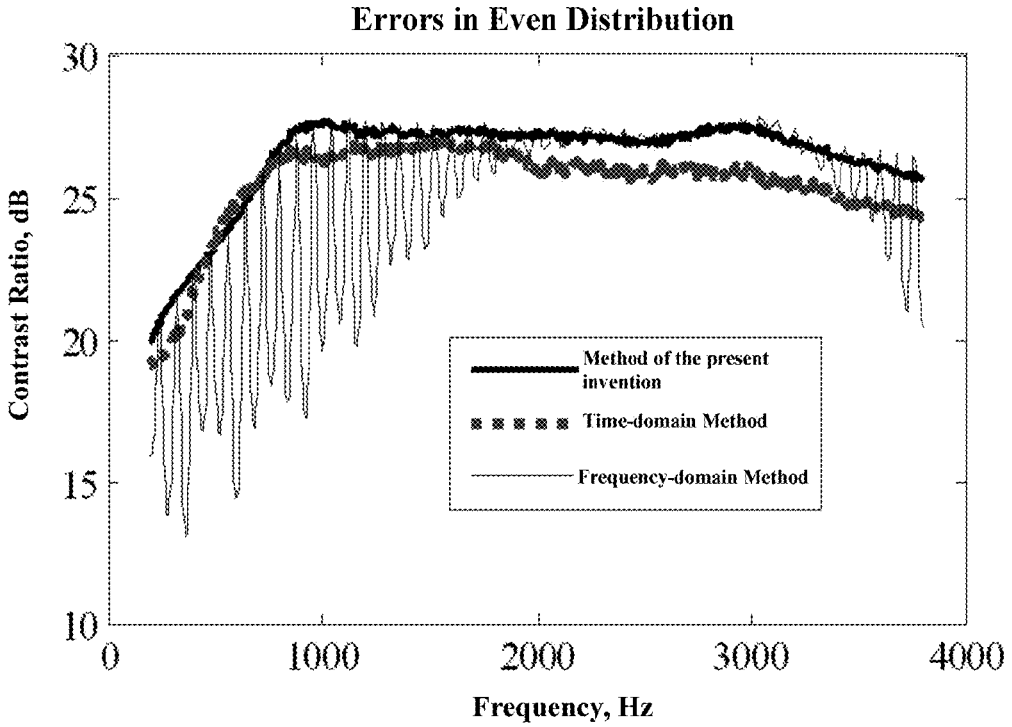
FIG. 4(*a*) is a comparing schematic diagram of the contrast performances of the present invention and the existing methods when the speaker frequency response errors are in even distribution.
Figure 4B:
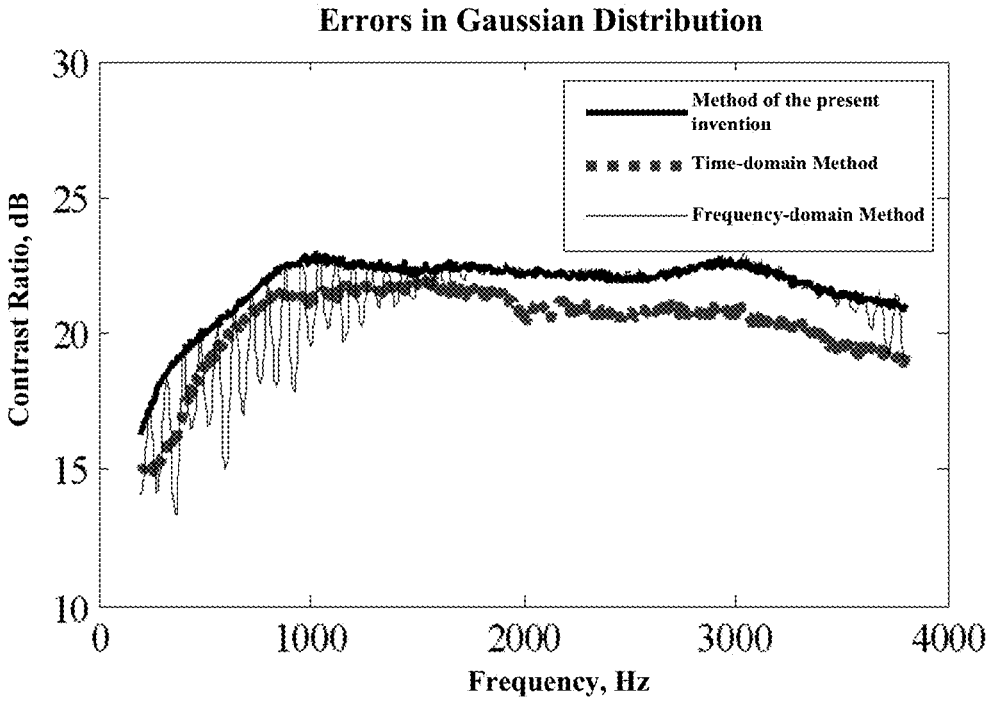

FIG. 4 present the expected wide band contrast performance of the present invention when the speaker frequency response errors exist and the comparison with the methods in the prior art. Wherein, the performance of the expected contrast $C_f$ is defined as follow:

$$C_f = E\left\{\frac{1}{K_B}\sum_{k=1}^{K_B}|\bar{p}_{Bk}(\omega)|^2 \Big/ \frac{1}{K_D}\sum_{k=1}^{K_D}|\bar{p}_{Dk}(\omega)|^2\right\}$$

It can be seen from the figures that, whatever errors are in even distribution or in Gaussian distribution, the wide band contrast performance of the frequency domain sound energy contrast control method (J. H. Chang, C. H. Lee, J. Y. Park and Y. H. Kim. A realization of sound focused personal audio system using acoustic contrast control. J Acoust. Soc. Am. 125(4):2091-7) in prior art is the worst, the contrast performances at some frequency points decrease rapidly, and the contrast performances can get a well effect only at limited control points. And, the time domain sound energy contrast control method (Y. Cai, M. Wu and J. Yang. Design of a time-domain acoustic contrast control for broadband input signals in personal audio systems. ICASSP 2013.) in prior art can get better expected contrast performance at the whole wide band. After comparison, it can be seen that, the expected contrast performance of the method of the present invention at the whole frequency band is better than the performance of the time domain method. This indicates that compared with the sound energy contrast control methods in the prior art, the present method shows better anti-interference performance on the speaker frequency response errors.

In the embodiment, the sampling frequency is set as 8 kHz, and the bright zone and the dark zone are selected to be a linear zone, however, this is merely an exampled illustration of the provided method of the present invention, and does not limit the provided method of the present invention to be applied to only the sound frequency range of people talking, or does not limit that the bright zone and the dark zone only can select a linear type. In practice, the method provided by the present invention can expand to wide band signals of the whole audible sound frequency range, and achieve multi-zone sound reproduction.

The present invention further provides an error model-based multi-zone sound reproduction device comprising:

a speaker array arranging module, to arrange the speaker array, and to set control points for a bright zone and a dark zone, wherein, the bright zone is a zone requiring the generation of an independent sound source, and the dark zone is all zones not requiring the generation of an independent sound source;

a speaker frequency response error obtaining module, to conduct probability distribution modeling on frequency response errors;

an expected average sound energy expression obtaining module, to list expected average sound energy expressions of the bright zone and the dark zone respectively;

a frequency response consistency constraint expression obtaining module, to select a reference frequency, and to list a frequency response consistency constraint expression of the bright zone;

a time-domain impulse response filter signal calculating module, to calculate a time-domain impulse response filter signal of each channel according to a time-domain sound energy contrast control criterion of the frequency response consistency constraint.

The above detailed describes the present invention, and the embodiments are only for contributing to understand the methods and the core concept of the present invention, and intended to make those skilled in the art being able to understand the present invention and thereby implement it, and should not be concluded to limit the protective scope of this invention. Any equivalent variations or modifications according to the spirit of the present invention should be covered by the protective scope of the present invention.

The invention claimed is:

1. An error model-based multi-zone sound reproduction method, comprising the following steps:

Step 1): arranging a speaker array, and setting control points for a bright zone and a dark zone; wherein, the bright zone is a zone requiring the generation of an independent sound source, and the dark zone is all zones not requiring the generation of an independent sound source;

Step 2): establishing a distribution model of speaker frequency response errors;

Step 3): according to the distribution model of speaker frequency response errors of Step 2) and the speak array, deriving expected average sound energy expressions and frequency response consistency constraint expressions of the bright zone and the dark zone with speaker frequency response errors existing;

Step 4): according to the expected average sound energy expressions and the frequency response consistency constraint expressions of Step 3), and according to a time-domain sound energy contrast control criterion of the frequency response consistency constraint, calculating a time-domain impulse response filter signal of each channel.

2. The error model-based multi-zone sound reproduction method according to claim 1, wherein, in the Step 1), the arranged speaker array is a linear array, a circular array, or a random array.

3. The error model-based multi-zone sound reproduction method according to claim 1, wherein, in the Step 1), the shape of the bright zone is square, circular, or linear;

or the shape of the dark zone is square, circular, or linear.

4. The error model-based multi-zone sound reproduction method according to claim 1, wherein, in the Step 2), the distribution model of speaker frequency response errors is obtained by measurement or by model prediction.

5. The error model-based multi-zone sound reproduction method according to claim 4, wherein, a method of establishing the distribution model of speaker frequency response errors of Step 2) by measurement comprises:

(1) measuring frequency responses of a set of speakers at frequency f, and obtaining amplitude distribution and phase distribution of the speaker frequency responses, respectively;

(2) acquiring the distribution model of speaker frequency response errors by fitting distribution curves according to the amplitude distribution and the phase distribution of the speaker frequency responses.

6. The error model-based multi-zone sound reproduction method according to claim 4, wherein, a method of establishing the distribution model of speaker frequency response errors of Step 2) by model prediction comprises:

(1) measuring the speakers of the Step 1) by acoustic instruments to obtain TS parameters, the TS parameters comprising voice coil direct current resistance, voice coil inductance, mechanical resistance, mechanical compliance, vibration quality, air radiation resistance, air radiation susceptibility, equivalent radiating area, and electromagnetic force induction coefficient;

(2) sampling the TS parameters by Monte Carlo method, simulating frequency responses of the speaker, and obtaining amplitude distribution and phase distribution of the speaker frequency responses;

(3) conducting curve-fitting according to the obtained amplitude distribution and phase distribution of the speaker frequency responses, and acquiring the distribution model of speaker frequency response errors.

7. The error model-based multi-zone sound reproduction method according to claim 1, wherein, the Step 3) comprises:

Step 3-1): assuming an expression of frequency response error $A_l(\omega)$ of a speaker l=1 . . . L at frequency ω is:

$$A_l(\omega)=a_l(\omega)e^{-j\varphi_l(\omega)}$$

wherein, $a_l(\omega)$ and $\varphi_l(\omega)$ respectively are amplitude and phase of the frequency response error and both are random variates, and L is the number of the speakers; then an expression of frequency response $\bar{p}_{Bk}(\omega)$ from the speaker array to a control point k=1 . . . $K_B$ of the bright zone is:

$$\bar{p}_{Bk}(\omega)=w^T[s_{Bk}(\omega)\circ A]$$

wherein, $K_B$ is the number of control points in the bright zone; ○ is the Hadamard product of matrix, and w is a vector formed by time-domain impulse response filter coefficients of each channel an expression of which is:

$$w=[w_l(0), \ldots, w_l(M-1), \ldots, w_L(0), \ldots, w_L(M-1)]^T$$

wherein, M is the filter order of each channel; an expression of $s_{Bk}(\omega)$ is:

$$s_{Bk}(\omega)=[r_{Bk}(0), \ldots, r_{Bk}(M+I-2)][1, e^{-j\omega}, \ldots, e^{-j\omega(I+M-2)}]^T$$

$$r_{Bk}(n)=[h_{Blk}(n), \ldots, h_{Blk}(n-M+1), \ldots, h_{BLk}(n), \ldots, h_{BLk}(n-M+1)]^T$$

wherein impulse responses between channel l of the speaker and control point k of the bright zone are modeled to be a FIR filter with a length of I, $h_{Blk}(n)$ is coefficient; an expression of A is:

$$A=[\underbrace{A_1(\omega), \ldots, A_1(\omega)}_{M\times 1}, \ldots, \underbrace{A_L(\omega), \ldots, A_L(\omega)}_{M\times 1}]^T,$$

time-domain average sound energy $\bar{e}_B$ radiated from the speaker array to the bright zone is:

$$\bar{e}_B=\sum_{k=1}^{K_B}\frac{1}{2\pi}\int_{-\pi}^{\pi}|\bar{p}_{Bk}(\omega)|^2 d\omega/K_B$$

since $\bar{e}_B$ is a random variate, the expected average sound energy $E\{\bar{e}_B\}$ of the bright zone is:

$$\begin{aligned}E\{\bar{e}_B\}&=w^T E\left\{\sum_{k=1}^{K}\frac{1}{2\pi}\int_{-\pi}^{\pi}[s_{Bk}(\omega)\circ A][s_{Bk}(\omega)\circ A]^H d\omega/K_B\right\}w\\&=w^T\sum_{k=1}^{K}\frac{1}{2\pi}\int_{-\pi}^{\pi}s_{Bk}(\omega)s_{Bk}(\omega)^H\circ E\{AA^H\}d\omega/K_B w\\&=w^T R_B w\end{aligned}$$

wherein, E{ } is an expected value of random variate, and $E\{AA^H\}$ comprises parameters of the error probability distribution model provided by Step 2);

Step 3-2): frequency response $\bar{p}_{Dk}(\omega)$ from the speaker array to a control point k=1 . . . $K_D$ of the dark zone is:

$$\bar{p}_{Dk}(\omega)=w^T[s_{Dk}(\omega)\circ A]$$

wherein, $K_D$ is the number of control points in the bright zone; an expression of $s_{Dk}(\omega)$ is:

$$s_{Dk}(\omega)=[r_{Dk}(0), \ldots, r_{Dk}(M+I-2)][1, e^{-j\omega}, \ldots, e^{-j\omega(I+M-2)}]^T$$

$$r_{Dk}(n)=[h_{Dlk}(n), \ldots, h_{Dlk}(n-M+1), \ldots h_{DLk}(n), \ldots, h_{DLk}(n-M+1)]^T$$

wherein impulse responses between channel l of the speaker and control point k of the dark zone are modeled to be a FIR filter with a length of I, $h_{Dlk}(n)$ is coefficient; hence the expected average sound energy of the dark zone is:

$$\begin{aligned} E\{\bar{e}_D\} &= \sum_{k=1}^{K_D} \frac{1}{2\pi} \int_{-\pi}^{\pi} |\bar{p}_{Dk}(\omega)|^2 d\omega / K_D \\ &= w^T \sum_{k=1}^{K_D} \frac{1}{2\pi} \int_{-\pi}^{\pi} s_{Dk}(\omega) s_{Dk}(\omega)^H \circ E\{AA^H\} d\omega / K_D w \\ &= w^T R_D w \end{aligned}$$

Step 3-3): selecting a reference frequency $\omega_r$, and defining frequency response consistency constraint RV of the bright zone an expression of which is:

$$\begin{aligned} RV &= \frac{1}{K_B} \frac{1}{B_\Omega} \sum_{k=1}^{K} \sum_{\omega \in \Omega} |w^T s_{Bk}(\omega) - w^T s_{Bk}(\omega_r)|^2 \\ &= w^T \Re\{Q^H Q\} w \end{aligned}$$

wherein, $\Re\{\ \}$ is taking the real part of this element, $\Omega$ is a set of all constraint frequency points, and an expression of Q is:

$$Q = \frac{1}{\sqrt{K_B B_\Omega}} \begin{pmatrix} s_{B1}(\omega) - s_{B1}(\omega_r) \\ \vdots \\ s_{BK}(\omega) - s_{BK}(\omega_r) \end{pmatrix}.$$

8. The error model-based multi-zone sound reproduction method according to claim 1, wherein, the Step 4) comprises:

Step 4-1): according to the time-domain sound energy contrast control criterion of the frequency response consistency constraint, listing an optimization function:

$$\max_w \frac{w^T R_B w}{\alpha w^T R_D w + (1-\alpha) w^T \Re\{Q^H Q\} w + \delta w^T w}$$

Step 4-2): solving the optimization function in Step 4-1):

$$w=P_{max}\{[\alpha R_D+(1-\alpha)\Re\{Q^H Q\}+\delta U]^{-1} R_B\}$$

wherein, $P_{max}\{\ \}$ is to solve an unit feature vector of corresponding maximum feature value of the matrix, U is unit matrix, $\delta$ is robustness parameter, and $\alpha$ is weighting parameter; parameters $\delta$ and $\alpha$ both take positive numbers;

Step 4-3): dividing the vector w obtained in Step 4-2) by every M elements, and obtaining the time-domain impulse response filter signal of each channel.

9. An error model-based multi-zone sound reproduction device, comprising, a speaker array arranging module, to arrange the speaker array, and to set control points for a bright zone and a dark zone, wherein, the bright zone is a zone requiring the generation of an independent sound source, and the dark zone is all zones not requiring the generation of an independent sound source;

a speaker frequency response error obtaining module, to conduct probability distribution modeling on frequency response errors;

an expected average sound energy expression obtaining module, to list expected average sound energy expressions of the bright zone and the dark zone respectively;

a frequency response consistency constraint expression obtaining module, to select a reference frequency, and to list a frequency response consistency constraint expression of the bright zone;

a time-domain impulse response filter signal calculating module, to calculate a time-domain impulse response filter signal of each channel according to a time-domain sound energy contrast control criterion of the frequency response consistency constraint.

* * * * *